United States Patent [19]

Moriyama

[11] Patent Number: 4,821,967

[45] Date of Patent: Apr. 18, 1989

[54] PAPER SHREDDER PAPER FEEDING SYSTEM

[75] Inventor: Hiroshi Moriyama, Yamatokoriyama, Japan

[73] Assignee: Sharp Kabushiki Kaisha, Osaka, Japan

[21] Appl. No.: 103,300

[22] Filed: Oct. 1, 1987

[30] Foreign Application Priority Data

Oct. 3, 1986 [JP] Japan ..... 61-152798[U]

[51] Int. Cl.[4] ..... B02C 18/22

[52] U.S. Cl. ..... 241/37.5; 241/223; 241/236

[58] Field of Search ..... 241/100, 236, 243, 224, 241/223, 222, 101 D, 225, 235, 34, 36, 37.5, 101.2, 101.1; 271/35, 165, 9; 83/500–503, 436

[56] References Cited

U.S. PATENT DOCUMENTS

| | | | |
|---|---|---|---|
| 3,682,402 | 8/1972 | Goldhammer | 241/100 |
| 4,062,500 | 12/1977 | Petersen, Jr. . | |
| 4,192,467 | 3/1980 | Hatanaka | 241/34 |
| 4,231,530 | 11/1980 | Hatanaka | 241/223 |
| 4,261,523 | 4/1981 | LaPointe . | |

FOREIGN PATENT DOCUMENTS

| | | | |
|---|---|---|---|
| 0244850 | 11/1987 | European Pat. Off. . | |
| 2731247 | 11/1978 | Fed. Rep. of Germany . | |
| 3434177 | 3/1986 | Fed. Rep. of Germany | 241/100 |
| 1171799 | 11/1969 | United Kingdom . | |
| 1171797 | 11/1969 | United Kingdom . | |
| 1540706 | 2/1979 | United Kingdom . | |
| 1568745 | 6/1980 | United Kingdom . | |
| 2036706 | 7/1980 | United Kingdom . | |
| 2039264 | 8/1980 | United Kingdom . | |
| 2039701 | 8/1980 | United Kingdom . | |
| 2061231 | 5/1981 | United Kingdom . | |
| 2131082 | 6/1984 | United Kingdom . | |

*Primary Examiner*—Mark Rosenbaum

*Attorney, Agent, or Firm*—Birch, Stewart, Kolasch & Birch

[57] ABSTRACT

A paper feeding system of a paper shredder comprises a paper set block provided in the shredder main body; a paper feed opening formed at the end of the paper set block on the side of the shredding cutter; a paper transport device for sending papers automatically through the paper feed opening to the shredding cutter; an openable cover for shielding the paper set block and the paper feed opening; a locking device for locking the cover in the closed position; and a paper insertion opening allowing papers to be input into the paper set block without opening the cover.

2 Claims, 2 Drawing Sheets

PAPER SHREDDER PAPER FEEDING SYSTEM

BACKGROUND OF THE INVENTION

The present invention relates to a paper feeding system of a paper shredder that cuts waste and confidential documents (including drawings) into fine pieces.

A paper shredder, which cuts discarded important documents into shreds, contains a paper feeding system for sending the documents inputted through the paper inlet of the shredder main body automatically to the cutter. The feeding system is equipped with a paper set block having a space large enough to accommodate a moderate amount of paper.

SUMMARY OF THE INVENTION

An object of the present invention is to provide a paper transport means-equipped paper shredder which has an openable cover with a locking function so as to prevent documents to be shredded from being stolen or viewed from the exterior, thereby protecting the secrecy of the documents.

Another object of the present invention is to provide a paper shredder that permits an operator to easily charge a paper set block with papers without unlocking and opening the cover of a paper set block.

The present invention comprises a paper set block in a shredder main body, a paper feed opening formed at the end of the paper set block on the side of the shredding cutter, paper transport means for sending papers automatically through the paper feed opening to the shredding cutter, a cover openably installed on the shredder main body to shield the paper set block and the paper feed opening, locking means for locking the cover in the closed position, and a paper insertion opening which allows papers to be inputted to the paper set block without unlocking the cover.

BREIF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
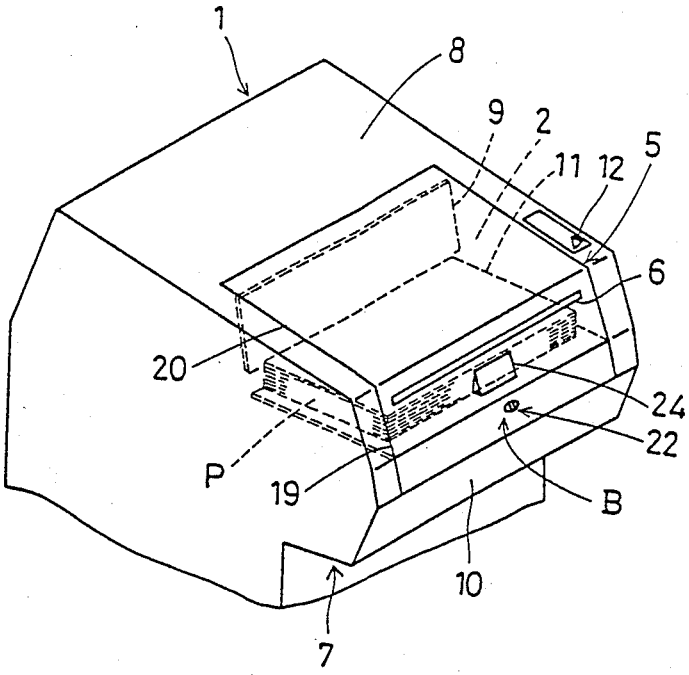
FIG. 1 is a perspective view of an essential part of an embodiment of the paper shredder of the present invention.
Figure 2:
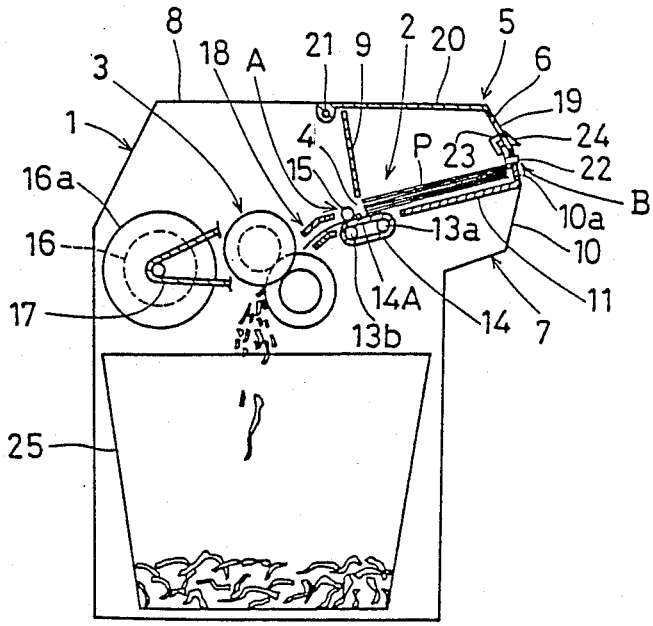
FIG. 2 is a vertical sectional view of the paper shredder of the present invention.

As shown in FIGS. 1 and 2, according to the present invention, a paper set block 2 is provied in the shredder main body 1 and a paper feed opening 4 is formed at the end of the paper set block 2 on the side of a shredding cutter 3. Paper transport means "A" is provided to direct paper automatically from the paper feed opening 4 to the cutter 3. An openable cover 5 is mounted over the paper set block 2 and the paper feed opening 4 in the shredder main body 1. A locking means "B" is provided to lock the cover 5 in its closed position. To allow an operator to input paper into the paper set block 2 without unlocking and opening the cover 5, a paper insertion opening 6 is formed in the cover 5.

The paper shredder 1 of the present invention is of a box shape having an upper portion protruded frontward to define a projection 7.

Figure 3:
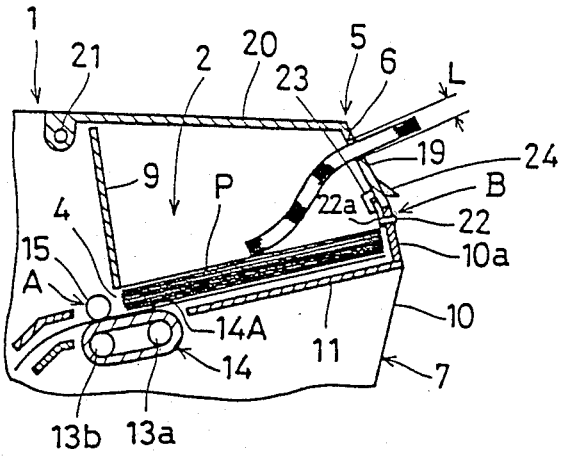
FIG. 3 is a vertical sectional view of an essential part of the paper shredder of the present invention.

As shown in FIG. 3, the paper set block 2 is a retracted space with respect to the top panel 8 of the main body 1 (FIGS. 1 and 2), comprising a perpendicular wall 9 provided downward from the approximate longitudinal center of the top panel 8 and a horizontal paper rest plate 11 provided rearward from the approximate center of the height of the front panel 10 of the projection 7. As shown in FIG. 1, the paper set block 2 extends laterally from left to right of the main body top panel 8, leaving some space on both sides for the shredder main body 1. An opeation switch 12 is located on the top panel 8 of the main body 1 on the right side of the paper set block 2.

The height of the perpendicular wall 9 is such that a moderate amount of paper is accommodated in the paper set block 2.

The paper rest plate 11 extends to the vicinity of the lower end of the perpendicular wall 9 leaving a space for the paper transport means "A" between the paper rest plate 11 and the lower end of the perpendicular wall 9. The upper face of the paper rest plate 11 is inclined downward from the front to the rear to lead paper to the paper feed opening 4.

The paper feed opening 4 is a laterally elongated slot formed between the lower end of the perpendicular wall 9 and the rear end of the paper rest plate 11.

The paper transport means "A" comprises a pair of paper transport rollers 13*a* and 13*b* which are located in the paper feed opening 4 adjacent the rear end of the paper rest plate 11 and are rotatable in the same direction (to the rear of the main body), an endless converyor belt 14 extended around the pair of the transport rollers 13*a* and 13*b*, a counterrotating roller 15 mounted to the upper side of the converyor belt 14 and rotatable in the direction opposite from the rotating direction of the transport rollers 13*a* and 13*b* (that is, to the front of the main body) so as to restrict the number of sheets to be supplied, a motor 16 for driving the transport rollers 13*a* and 13*b* and the counterrotating roller 15 and, a chain belt 17 and a sprocket for converting the driving force of the motor 16 to the rotating force and transmitting it to the rollers 13*a*, 13*b* and 15.

The transport rollers 13*a* and 13*b* are rotatably supported through the rotary shafts by the main body 1. The paper transporting surface 14A of the converyor belt 14 is flush with and has the same inclination as the upper face of the paper rest plate 11.

The counterrotating roller 15 is installed in the vicinity of the transporting surface 14A of the conveyor belt 14 with a gap left to allow a specified quantity of papers to pass. The counterrotating roller 15 is rotatably supported through the rotary shaft by the main body 1.

The driving motor 16 is installed in the rear part of the main body 1. The motor 16 is housed in a motor casing 16*a* which is fixed to the main body 1.

A pair of paper guide plates 18 is vertically arranged adjacent the rear end of the transorting surface 14A of the conveyor belt 14. The guide plates 18 are also inclined downward toward the rear side at approximately the same angle with the inclination of the paper rest plate 11 and supported by the side walls of the main body 1.

The shredding cutter 3 comprises a pair of rotary blade rollers whose rotary shafts are rotatably fixed to the side walls of the main body 1. The position of the shredding cutter 3 is such that the two blade rollers are engaged with each other in the vicinity of the rear end of the guide plates 18. The cutter 3 is roated simultaneously with the transport rollers 13*a* and 13*b* and the counterrotating roller 15 by the driving force of the motor 16.

The cover 5 is of an approximate L-shape in the section and comprises a front section 19 for covering the front side of the paper set block 2 when closed and a top section 20 whose upper surface is flush with the main body top panel 8 when closed. The cover 5 is supported by the main body 1 through a lateral shaft 21 provided on the rear end of the top section 20 so that it is pivotally opened or closed.

The locking means "B" comprises a key lock system whose structure is well known. Specifically, as shown in FIG. 3, the locking means "B" comprises a key cylinder 22 rotatably fit under the front section of the cover 5 at the approximate center of a front part 10*a* of the projection 7, an engaging member 22*a* rotatably provided on the cylinder 22 and, a locking hole 23 formed in the lower part of the front section 19 of the cover 5 to be engaged with the engaging member 22*a*. The locking means "B" is locked or unlocked by an appropriate key.

The paper insertion opening 6 is formed in the upper part of the front section 19 of the cover 5. It is a laterally elongated rectangular opening. Desirably, the height "L" of the insertion opening 6 is, as shown in FIG. 3, not larger than 10 mm so that hands or fingers cannot be inserted to take paper out of the paper set block 2.

In the drawings, 24 is a handle with which to open or close the cover 5 and, 25 is a shred reservoir provided inside the main body to collect the shredded paper.

To shred documents with the shredder of the present invention, an operator opens the cover 5, places a batch of papers (represented by "P" in FIGS. 2 and 3) in the paper set block 2 and pushes the switch 12 ON to actuate the driving motor 16. Then, the transport rollers 13*a* and 13*b*, the counterrotating roller 15 and the shredding cutter 3 start rotating simultaneously. The rotation of the transport rollers 13*a* and 13*b* causes the conveyor belt 14 to rotate so that the transporting surface 14A of the belt 14 moves rearward. As a result, the bottom paper of the batch "P" is sent through the paper feed opening 4 to the passage between the guide plates 18. Meanwhile, the counterrotating roller 15 restricts the number of sheets being carried on the transporting surface 14A of the belt 14 to the guide plates 18. Therefore, more than the specified quantity of paper is never supplied at one time to the guide plates 18. Papers are supplied successively and smoothly from the bottom side of the batch "P", never causing clogging.

Papers that have been led between the guide plates 18 are cut into fine strips by the shredding cutter 3. The strips of paper drop into the shred reservoir 25.

By the way, the operator may want to leave the shredder while papers are being shredded. In that case, the operator puts a batch of moderate quantity of papers "P" in the paper set block 2, pushes the switch 12 ON, closes the cover 5 and rotates the key in the key cylinder 22. Then, the engaging member 22*a* is fit in the locking hole 23, locking the cover 5. The cover 5 shields the documents and cannot be opened, preventing the documents from being stolen and protecting the secrecy of the documents.

As the papers are being shredded, the amount of papers in the paper set block 2 decreases, resulting in an increased open sapce in the paper set block 2. If the operator has a further batch of papers to be shredded or wants to add only a few sheets of papers to the batch "P" in the paper set block 2, he may insert them through the paper insertion opening 6, as shown in FIG. 3. The inserted papers are placed on top of the papers remaining in the paper set block 2.

Thus, according to the present invention, it is possible to charge the paper set block 2 with papers quite easily without unlocking and opening the cover 5 of the paper set block 2.

It is not our intention that the present invention be limited by the detailed descriptions given above. Obviously, various modifications and variations may be made within the scope of the present invention.

For instance, the paper insertion opening 6 may not always formed in the cover 5. It may be formed in another position independent of the cover so long as it communicates with the paper set block 2 or directly with the shredding cutter 3. A resilient cover may be provided over the paper insertion opening 6 to prevent the papers in the paper set block 2 from being viewed through the opening 6. In that case, the resilient cover needs to have such a construction that it is deformed inwardly when depressed by papers to be inserted.

Further, it should be understood that the shape of the cover 5 and the constructions of the paper transport means "A" and of the locking means "B" are not limited to those described in the above embodiment.

According to the present invention, as understood from the above, if an operator wants to leave the shredder after charging the paper set block 2 with a batch of moderate amount of paper "P" and actuating the shredder, he is to close and lock the cover 5. Then the cover 5 isolates the papers from the exterior and cannot be opened unless unlocked. Consequently, it is not necessary to anticipate the theft of the papers or the leakage of confidential information.

As the papers are shredded, the amount of paper remaining in the paper set block 2 decreases, resulting in an increased open space in the paper set block 2. At this time, if the operator wants to shred additional paper, he may insert the additionaly paper through the insertion opening 6, as shown in FIG. 3. The paper inserted is placed on top of the paper remaining in the paper set block 2.

In this way, paper to be shredded can be easily put in the paper set block 2 repetitively without unlocking and opening the cover 5.

While only certain embodiments of the present invention have been described, it will be apparent to those skilled in the art that various changes and modifications may be made therein without departing from the spirit and scope of the present invention as claimed.

What is claimed is:

1. A paper shredding system comprising:

a shredder main body;

a paper shredding cutter;

a paper set block provided in said shredder main body;

a paper feed opening formed within said paper set block on the shredding cutter side of said main body;

paper transport means for sending paper automatically through said paper feed opening to said paper shredding cutter;

a rotatably mounted cover for opening and closing said paper set block for enclosing and shielding said paper set block and said paper feed opening, said cover having a front section for covering a front side of said paper set block when said cover is closed;

locking means for locking said cover in a closed position; and a paper insertion opening provided in said cover for inserting paper into said paper set block without opening said cover, said paper insertion opening being formed in an upper part of a front section of said cover such that paper to be shredded may be inserted into said paper set block during a paper shredding operation through said paper insertion opening while said cover is locked in said closed position, said inserted papers being placed on top of the papers already present and remaining in said set block.

2. The paper shredding system of claim 1, wherein said paper insertion opening has a laterally elongated rectangular shape constructed so that hands or fingers cannot be inserted into said insertion opening.

* * * * *